US005226684A

United States Patent [19]

De La Garza

[11] Patent Number: 5,226,684

[45] Date of Patent: Jul. 13, 1993

[54] GATE LATCH

[76] Inventor: Efrain S. De La Garza, 6475 Old Highway 90 West, San Antonio, Tex. 78227

[21] Appl. No.: 989,634

[22] Filed: Dec. 11, 1992

[51] Int. Cl.[5] ..... E05C 1/10

[52] U.S. Cl. ..... 292/213; 292/238

[58] Field of Search ..... 292/202, 213, 218, 238, 292/230, DIG. 9, 45, 214

[56] References Cited

U.S. PATENT DOCUMENTS 249,761 11/1881 Hassinger ..... 292/213

2,074,759 3/1937 Richards ..... 292/213 X 3,810,667 5/1971 Dugan ..... 292/DIG. 9

3,888,527 6/1975 Haisler ..... 292/213

*Primary Examiner*—Richard E. Moore

*Attorney, Agent, or Firm*—G. Turner Moller

[57] ABSTRACT

A gate latch having a U-shaped bracket secured to a gate post by a U-shaped threaded fastener, the bracket having an upper section with a curved upper end, and a link with a U-shaped notch for receiving a gate frame, the link being movably secured to the bracket by a horizontal slot which receives the curved upper end of the bracket.

11 Claims, 1 Drawing Sheet

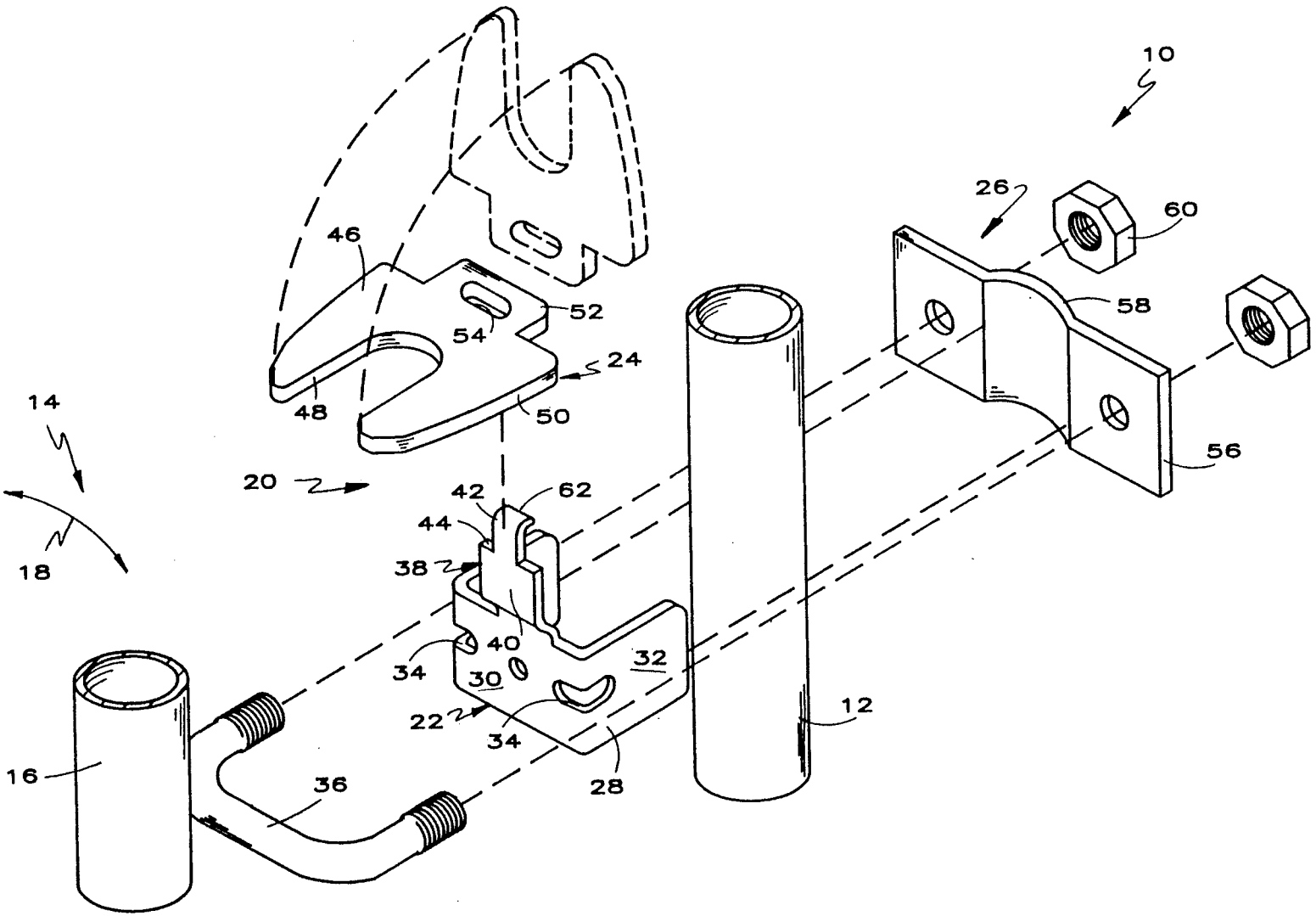
10
60
58
56
26
12
32
28
24
52
50
62
40
30
34
54
42
44
38
22
34
46
48
20
36
14
18
16

GATE LATCH

This invention relates to a gate latch of the type used to temporarily retain a gate in a closed condition.

Chain link fences are very common and are often known by the colloquial name "hurricane" fence. Such fences typically comprise stationary posts made of pipe and chain link fence materialstretched between the posts. Gates in such fences typically comprise a pipe or conduit frame with chain link material between the frame sides and ends. These gates are pivotally mounted on posts which are almost always pipe. Several different varieties of gate latches are available, one of which is a simple pivoted metal link having a U-shaped end for receiving the pipe frame of the gate. By lifting the metal link, the gate is freed for movement. This type gate latch is often thought of and used as a dog latch because it mainly keeps a dog from pushing against and opening the gate. It is this type gate latch with which this invention most nearly relates.

These prior art gate latches are pivotally connected to a bracket cinched up against a stationary gate post. The prior art gate latches comprise a bracket attached to a stationary fence post and a metal link pivotally connected to the bracket and providing a U-shaped notch for receiving a gate frame to thereby immobilize the gate. The pivotal connection comprises a pair of aligned slots provided by the bracket and an elongate member on the back of the metal link having ears extending through the aligned slots. The prior art gate latches also have outwardly extending ears which are grasped by a person to lift the latch and release the gate for movement. For reasons which are not clearly apparent, these ears are prone to break off in use or abuse.

The gate latch of this invention includes a bracket attached to a post to which the gate is latched. The bracket includes a single upstanding arm which extends through a single central slot in a pivoted metal link having a U-shaped end. The link is thus mounted for movement between a first generally horizontal position where the U-shaped end receives part of the gate frame and a second usually vertical position where the link is out of engagement with the gate frame thereby freeing the gate for movement. Thus, the gate latch is free of ears which are normally grasped by the user and which are prone to break off.

In summary, the gate latch of this invention comprises a U-shaped bracket including a back and a pair of spaced parallel legs extending away from the back and providing a slot for receiving a stationary gate post, a single arm upstanding from the back and comprising a lower section and a smaller upper section providing at least one shoulder between the upper and lower sections, the upper section providing a curved upper end extending in the same direction as the parallel arms, means for attaching the bracket to the stationary gate post and a link comprising a body having a U-shaped notch sized to receive a gate frame and a single ear having a horizontal slot therein receiving the upper section of the bracket arm, the link being movable from a horizontal position where the link body rests on the shoulder and the U-shaped notch is positioned to receive a gate frame and a vertical position where the U-shaped notch is free of the gate frame.

It is an object of this invention to provide an improved gate latch.

A more specific object of this invention is to provide a gate latch assembly free of projecting ears which are normally grasped by a user to raise the latch.

These and other objects of this invention will become more fully apparent as this description proceeds, reference being made to the accompanying drawings and appended claims.

IN THE DRAWINGS

The figure is an exploded isometric view of a gate and gate latch of this invention.

Referring to the figure, a fence 10 includes a stationary post 12 comprising a pipe or conduit to which fence material (not shown), such as chain link material, is attached in a conventional manner. A gate 14 includes a frame 16 made of pipe or conduit having fence material (not shown) stretched between the sides and ends of the frame 16. The gate 14 is mounted in a conventional manner (not shown) for pivotal movement about a vertical axis in an arc suggested by the arrow 18.

A gate latch 20 temporarily secures the gate 14 to the post 12. The gate latch 20 comprises, as major components, a bracket 22 having a pivoted link 24 mounted thereon and a U-bolt assembly 26 securing the bracket 22 to the post 12.

The bracket 22 is rather similar to prior art brackets and comprises a U-shaped metal stamping 28 having a generally planar back 30 and parallel planar arms 32 spaced apart to closely receive the post 12. The corners of the stamping 28 provides notches 34 for receiving the U-bolt 36. The bracket 22 also includes a single upstanding arm 38 having a lower section 40 offset slightly away from the post 12 and a smaller upper section 42 providing a pair of shoulders 44 therebetween. The upper section 42 is curved toward the post 12 for receiving and retaining the link 24 thereon.

The link 24 is typically a metal stamping 46 having a U-shaped notch 48 sized to receive the gate frame 16 and diverging outer edges 50 which are sufficiently wide to be grasped by a person for raising the link to its vertical gate releasing position shown in dotted lines. The rear of the link 24 comprises an ear 52 having a slot 54 therein sized to receive the curved end of the upper section 42 of the bracket 22. Because of the offset position of the lower bracket arm section 40, the thickness of the material in the ear 52 between the slot 54 and the end of the ear 52 is increased and is thereby sufficient to withstand normal use and abuse.

The U-bolt assembly 26 includes the conventional threaded U-bolt 36, a conventional backup plate 56 having an offset central portion 58 for straddling the post 12 and a pair of threaded nuts 60 for attachment to the U-bolt 36 thereby captivating the bracket 22 to the post 12.

Operation and assembly of the gate latch 20 should now be apparent. After the fence 10 is built and the gate 14 installed, the bracket 22 is attached to the post 12 at a location where the gate frame 16 approaches the post 12. The upper section 42 of the arm 38 is inserted into the slot 54 of the link 24 before the bracket 22 is completely cinched up against the post 12 because the gap between the extreme end 62 of the link 24 and the post 12 is less than the distance between the rear of the slot 54 and the rear of the ear 52. Thus, the link 24 is captivated between the bracket 22 and the post 12.

It will be seen that the gate latch 20, and particularly the metal link 26, is free of projecting ears that can be broken off thereby avoiding problems of the prior art.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A gate latch assembly comprising a U-shaped bracket comprising a back and a pair of spaced parallel legs extending away from the back and providing a generally U-shaped section for receiving a stationary gate post, a single arm upstanding from the back and comprising a lower section and a smaller upper section providing at least one shoulder between the upper and lower sections, the upper section providing a curved upper end extending in the same direction as the parallel arms;

means for attaching the bracket to the stationary gate post; and a link comprising a body having a U-shaped notch sized to receive a gate frame and a single ear having a horizontal slot therein receiving the upper section of the bracket arm, the link being movable from a horizontal position where the link body rests on the shoulder and the U-shaped notch is positioned to receive a gate frame and a vertical position where the U-shaped notch is free of the gate frame.

2. The gate latch assembly of claim 1 wherein the link body provides diverging outer edges having the U-shaped notch extending therebetween and opening toward a front end of the link, the single ear being at a rear end of the link.

3. The gate latch assembly of claim 2 wherein the upper and lower sections of the bracket arm provide a pair of spaced shoulders therebetween.

4. The gate latch assembly of claim 3 wherein the upper section of the bracket arm is positioned symmetrically relative to the lower section of the bracket arm and the pair of spaced shoulders are of the same dimension.

5. The gate latch assembly of claim 4 wherein the bracket back is planar and the lower section is offset relative to the bracket back in a direction away from the parallel legs.

6. The gate latch assembly of claim 1 wherein the bracket back is planar and the lower section is offset relative to the bracket back in a direction away from the parallel legs.

7. A gate assembly comprising a stationary post, a gate havin a frame and means mounting the gate for swinging movement to a position adjacent the stationary post and a gate latch assembly for temporarily securing the gate to the stationary post, the gate latch assembly comprising a U-shaped bracket comprising a back and a pair of spaced parallel legs extending away from the back and providing a slot for receiving the stationary gate post, a single arm upstanding from the back and comprising a lower section and a smaller upper section providing at least one shoulder between the upper and lower sections, the upper section providing a curved upper end extending in the same direction as the parallel arms;

means for attaching the bracket to the stationary gate post; and a link comprising a body having a U-shaped notch sized to receive the gate frame and a single ear having a horizontal slot therein receiving the upper section of the bracket arm, the link being movable from a horizontal position where the link body rests on the shoulder and the U-shaped notch is positioned to receive a gate frame and a vertical position where the U-shaped notch is free of the gate frame.

8. The gate latch assembly of claim 7 wherein the link body provides diverging outer edges having the U-shaped notch extending disposed therebetween and opening toward a front end of the link, the single ear being at a rear end of the link.

9. The gate latch assembly of claim 8 wherein the upper and lower sections of the bracket arm provide a pair of spaced shoulders therebetween.

10. The gate latch assembly of claim 9 wherein the upper section of the bracket arm is positioned symmetrically relative to the lower section of the bracket arm and the pair of spaced shoulders are of the same dimension.

11. The gate latch assembly of claim 10 wherein the bracket back is planar and the lower section is offset relative to the bracket back in a direction away from the parallel legs.

* * * * *